US005810075A

United States Patent [19]

Deeke et al.

[11] Patent Number: 5,810,075

[45] Date of Patent: Sep. 22, 1998

[54] HEAT-INSULATING LINING ON HEAT EXCHANGER SURFACES

[75] Inventors: Wolfgang Deeke, Mettmann; Michael Havlik, Krefeld; Jürgen Heering, Meerbusch; Klaus Köhnen, Mülheim, all of Germany

[73] Assignees: MAN Gutehoffnungshütte Aktiengesellschaft, Oberhausen; Karrena GmbH, Ratingen-Lintorf, both of Germany

[21] Appl. No.: 962,379

[22] Filed: Oct. 31, 1997

[30] Foreign Application Priority Data

Nov. 4, 1996 [DE] Germany ..... 196 45 390.9

[51] Int. Cl.[6] ..... F28F 19/00

[52] U.S. Cl. ..... 165/134.1; 165/135; 165/56; 165/171; 122/DIG. 13

[58] Field of Search ..... 165/49, 56, 134.1, 165/135, 168, 171; 122/512, DIG. 13

[56] References Cited

U.S. PATENT DOCUMENTS

| | | | |
|---|---|---|---|
| 2,079,982 | 5/1937 | Belohlavek | 165/171 |
| 2,169,972 | 8/1939 | Cassidy | 165/171 X |
| 2,267,027 | 12/1941 | Hardgrove | 165/135 X |
| 3,305,011 | 2/1967 | Smith, Jr. | 165/171 |

FOREIGN PATENT DOCUMENTS

| | | | |
|---|---|---|---|
| 2336902 | 2/1975 | Germany | 165/135 |
| 1245852 | 7/1986 | U.S.S.R. | 165/135 |
| 328557 | 4/1930 | United Kingdom | 165/135 |

*Primary Examiner*—Allen J. Flanigan
*Attorney, Agent, or Firm*—McGlew and Tuttle

[57] ABSTRACT

A heat-insulating lining on heat exchanger surfaces for reducing the heat flow at the cooling surfaces of a medium- or high-pressure heat exchanger, which comprises a tube-web-tube wall. Corrosion resistant fastening pins are arranged in a weld area on the webs of the cooling surface. A ceramic fiber material is arranged as a heatinsulating material on both sides of the webs up to the level of the outside of the tubes of the tube wall, and segments of a ceramic moleskin mat, which are held by fastening pins and fastening washers, are arranged above it on both sides. An expanded metal, which is protected by a refractory material with good corrosion resistance, is additionally arranged at one or both edge zones and at the locations of the joints of the moleskin mat segments.

12 Claims, 3 Drawing Sheets

HEAT-INSULATING LINING ON HEAT EXCHANGER SURFACES

FIELD OF THE INVENTION

The present invention pertains to a heat-insulating lining for reducing the heat transfer capacity or for protection from excess temperature of the cooling surfaces of a medium or high-pressure heat exchanger.

BACKGROUND OF THE INVENTION

This type of heat-insulating lining of a tube-web-tube wall is used especially in radiant coolers at the tube cage or at platen surfaces.

A prior-art heat exchanger lining is used when the cooling surfaces of newly developed heat exchangers are designed, in which no pertinent experience is available in terms of the contamination behavior concerning design and the materials (e.g., stainless steel).

It may turn out during the ongoing operation that the actual contamination of the heating surfaces is lower than the theoretically assumed contamination. This leads to a better-than-expected cooling and thus to a lower gas outlet temperature than was theoretically calculated in advance.

To avoid an excessively low gas-side outlet temperature from the heat exchanger, the heat transfer surface is deactivated either by interrupting the feed of water to individual tubes, by removing tubes or by applying refractory materials and/or tamping clay.

The interruption of the feed of water or the removal of individual tubes is usually an irreversible change on the components. The application of tamping clay requires the welding-on of pins and/or anchors on the tube-web-tube assembly, especially also on parts (tubes) to which pressure is admitted, in order to guarantee the load-bearing and adhesion of the tamping clays.

Since any weld causes thermal stresses and may be the starting point of cracks under certain circumstances, the welding of pins on continuous tubes is always disadvantageous. In addition, the tamping clays may sometimes introduce a considerable additional weight into the component, which are frequently difficult to support.

Furthermore, it is necessary to dry the tamping clay according to a time-versus-temperature curve specified by the manufacturer in order to achieve its suitability for use. The drying procedure may be associated with a considerable expense.

If too much of the heat exchanger surface is covered with tamping clay, the removal of this heat insulation is possible at a considerable expense only, because the pins or anchors also must be ground off after the pulling off of the tamping clay, in order to avoid zones characterized by the probability of failure due to local overheating of the metal.

SUMMARY AND OBJECTS OF THE INVENTION

The primary object of the present invention is therefore to provide a lining that leads to a specific reduction in heat exchange, can be applied in a relatively simple manner, makes possible a simple later adjustment by removing parts or by applying more lining, does not require any welding on parts exposed to pressure, does not introduce a great additional weight load into the component, and whose surface hardens in air of normal temperature, so that a complicated drying process using a drying burner is not necessary.

This object is accomplished by providing a plurality of tubes with a plurality of webs joining the tubes to form a tub-web-tube wall. Fastening pins are welded only to the plurality of webs. Each fastening pin has a fastening washer. Heat insulating material is arranged on the plurality of webs and in between the plurality of tubes. The heat insulating material and the plurality of tubes form a substantially flat surface. A plurality of ceramic moleskin mat segments are then fastened to the fastening pins and the fastening washers on top of the substantially flat surface. Expanded metal is then arranged on the ceramic mat segments adjacent to the plurality of fastening pins and adjacent to edge zones of the mat segments.

An increase in the outlet temperature of the gas from the heat exchanger is achieved as a result according to the present invention.

The present invention may, of course, also always be used for the protection of heat-sensitive areas under the above-mentioned boundary and general conditions, besides the above-described case of application.

The embodiment of the present invention is characterized in that a material with low thermal conductivity, which can be installed in a simple manner, has the required temperature stability, low weight, does not require drying with a drying burner and has a sufficient abrasion resistance, e.g., ceramic moleskin in the mat form, is applied to the outside of the tube-web-tube assembly such that it completely covers the surface of a selected area. The space between the mat and the tube-web-tube assembly in the web area is filled with the same material or another material with likewise low thermal conductivity, e.g., a ceramic fiber material.

The ceramic moleskin in the mat form is fastened to the tube-web-tube assembly by means of pins with fastening washers. The pins, made of, e.g., corrosion-resistant stainless steel, are welded only to the webs of the tube-web-tube assembly. As a result, components, the tubes, exposed to pressure are not affected. The fastening pins are arranged such that the pins are located at the top edge and at the lower edge of the mat segments and, as needed, within the mat segment. The fastening pins and the fastening washers are each provided with threads in order to guarantee a firm hold of the moleskin mats.

In addition, a coolant distributor (distribution tube) of the heat exchanger may be used as the basis for the narrow side of the lowermost mat.

To achieve a better fastening and to prolong the service life, additional expanded metal strips are used, namely, in the area of mat joints of the ceramic moleskin mat and depending on any additional fastening needs of the component to be lined. The expanded metal is arranged between the gas-side mat surface and the fastening washers.

A refractory material with high heat resistance and impermeability to gases, e.g., refractory putty, is applied to the expanded metal strips along with corresponding fastening washers in order to protect the above-mentioned parts from the gas atmosphere and corrosion.

The top edge and/or the lower edge and/or the front edge(s) of the entire mat surface are secured against fraying and loss of material with folded expanded metal strips. These folded expanded metal strips are fastened to the webs of the tube-web-tube assembly by means of the pins with fastening washers.

The gas-side surfaces of the folded expanded metal strips are also protected with refractory material with good corrosion resistance.

If action needs to be taken in terms of changing the size of the heat-insulating lining during the operating time of the equipment in the case of changing contamination behavior, such action can be taken by removing partial mats or additionally applying partial mats, correspondingly displacing the folded expanded metal strips.

The refractory material with low thermal conductivity applied to the gas-side surface is selected to be such that its drying in air of normal temperature shall be sufficient for drying.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

BRIEF DESCRIPTION OF THE DRAWINGS In the drawings.

DESCRIPTION OF THE PREFERRED EMBODIMENT

Figure 1:
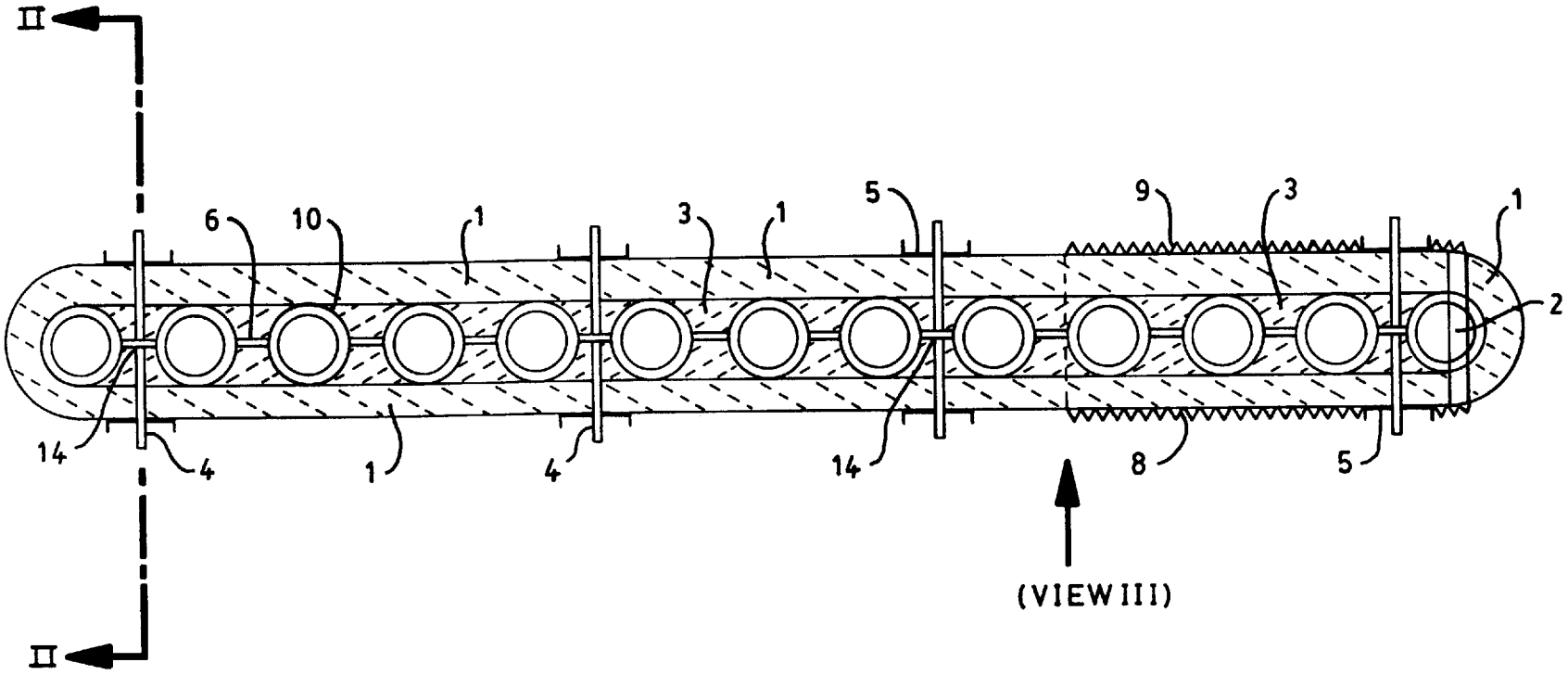
FIG. 1 is a sectional view I—I of FIG. 3 through the cooling surface.
Figure 3:
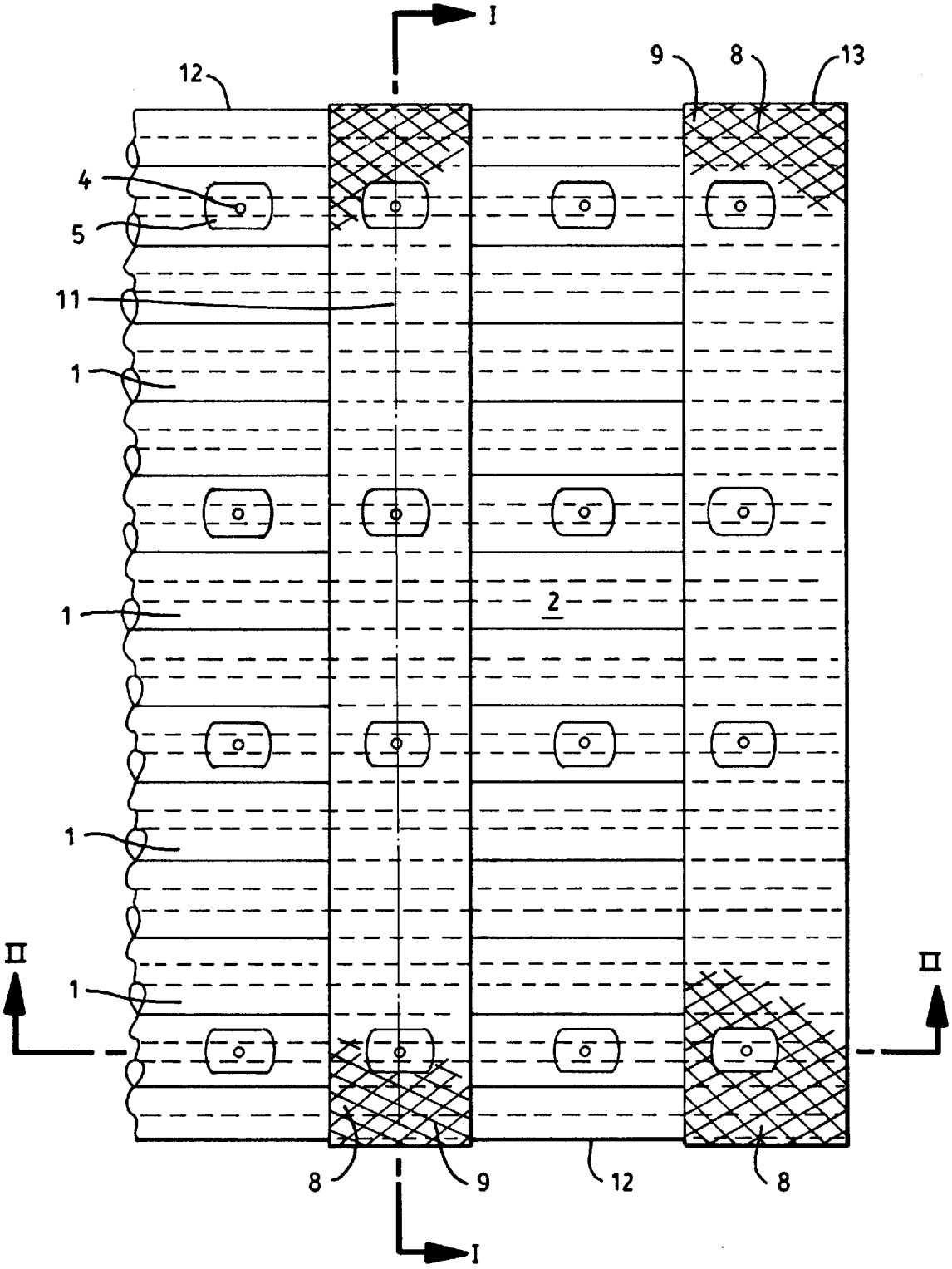
FIG. 3 is a plan view III of FIG. 1 of the heat-insulating lining of the cooling surface.

Referring to the drawings, especially FIG. 1, a cross section I—I of FIG. 3 through the cooling surface 2 of the heat exchanger is shown. The heat exchanger includes a tube-web-tube wall made of tubes 10 and webs 6. Corrosion-resistant fastening pins 4 are arranged in a weld 14 on the webs 6 of the cooling surface 2.

A ceramic fiber material 3 is applied as a heat-insulating material on both sides of the webs 6 up to the level of the outside of the tubes of the tube wall 10, and segments of a ceramic moleskin mat 1, which are held by fastening pins 4 and fastening washers 5, are laid over that material on both sides.

An expanded metal 8, which is protected by a refractory material 9 with good corrosion resistance, is additionally arranged at one or both edge zones and at the locations of the joints of the mat segments 1.

Figure 2:
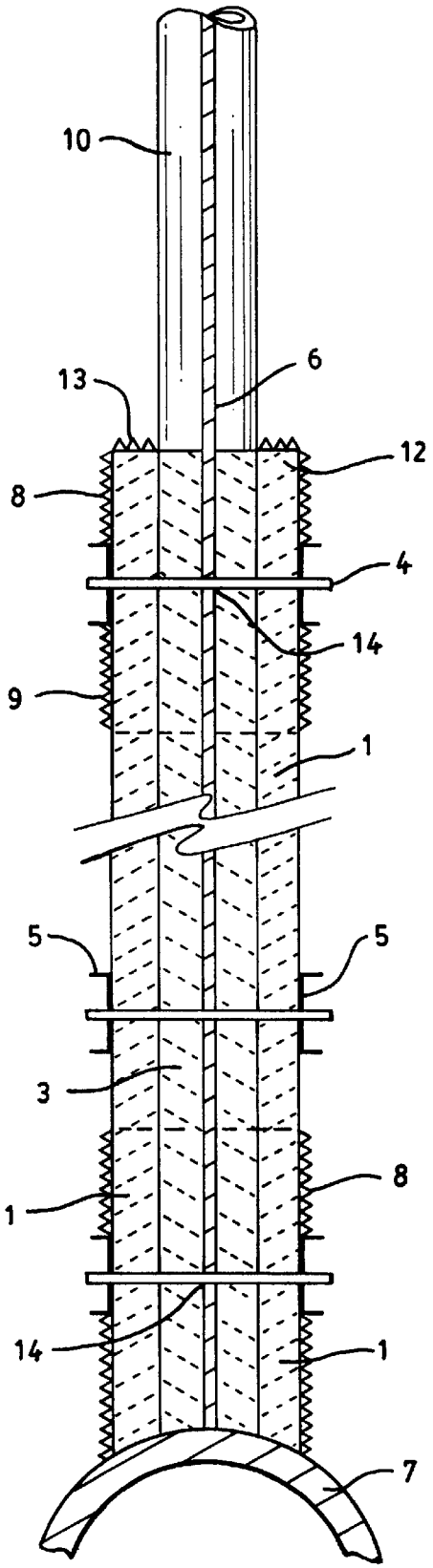
FIG. 2 is a sectional view II—II of FIGS. 1,3 through an individual tube.

FIG. 2 is a sectional view II—II through or along one of the tubes 10 of the cooling surface, which is welded to a coolant distribution tube 7 or collector. The fastening pins 4 for the segments of the ceramic moleskin mat 1 are fastened to the web 6 at the welds 14. A ceramic material 3 is applied in the area of the tubes 10, and the segments of the moleskin mat 1 are tightly or flush in contact with the tube 10 and the ceramic material 3.

The segments of the moleskin mat 1 are pushed through the fastening pins 4 and are pressed on by means of fastening washers 5. The upper end of the segments of the moleskin mat 1 are held with a folded expanded metal strip 13 in order for the segments of the moleskin mat 1 to be tightly in contact not only in the area of the fastening pins 4 at the tube 10, but also at the edge zones 12 and not to fray and in order to prevent loss of material from occurring.

FIG. 3 is a view as indicated by the numeral III as shown in FIG. 1 of the heat-insulating lining of the cooling surfaces 2.

The segments of the moleskin mat 1 are held by the fastening washers 5, which are attached to the fastening pins 4, at regularly spaced locations.

Expanded metal strips 8, which are additionally lined with a refractory material putty 9, are used in the embodiment shown here.

An expanded metal 8, 13 is arranged in this exemplary embodiment in every other pin row 11 and in the edge zones 12 of the cooling surface 2 and of the ceramic segments of the moleskin mat 1.

While specific embodiments of the invention have been shown and described in detail to illustrate the application of the principles of the invention, it will be understood that the invention may be embodied otherwise without departing from such principles.

What is claimed is:

1. A heat exchanger comprising:

a plurality of tubes;

a plurality of webs joining said tubes to form a tub-web-tube wall;

fastening pins welded to said plurality of webs;

a plurality of fastening washers, each fastening pin having one of said fastening washers;

heat insulating material arranged on said plurality of webs and in between said plurality of tubes, said heat insulating material and said plurality of tubes forming a substantially flat surface;

a plurality of ceramic moleskin mat segments fastened to said fastening pins and said fastening washers;

expanded metal arranged on said ceramic mat segments adjacent said plurality of fastening pins and adjacent edge zones of said mat segments.

2. A heat exchanger in accordance with claim 1, wherein:

said fastening pins are only welded to said webs;

said fastening pins are aligned into a plurality of pin rows.

3. A heat exchanger in accordance with claim 1, wherein:

said plurality of ceramic moleskin mat segments are applied to said plurality of tubes and said heat insulating material forming said substantially flat surface.

4. A heat exchanger in accordance with claim 2, wherein:

said expanded metal includes a plurality of expanded metal strips fastened by said fastening pins and fastening washers, said metal strips being positioned in every other one of said plurality of pin rows and on said edge zones of said mat segments.

5. A heat exchanger in accordance with claim 3, wherein:

said expanded metal includes a plurality of expanded metal strips fastened by said fastening pins and fastening washers, said metal strips being positioned in every other one of said plurality of pin rows and on said edge zones of said mat segments.

6. A heat exchanger in accordance with claim 1, wherein:

said expanded metal, said fastening washers and a portion of said fastening pins are covered with a corrosion-resistant refractory material.

7. A heat exchanger in accordance with claim 4, wherein:

said expanded metal, said fastening washers and a portion of said fastening pins are covered with a corrosion-resistant refractory material.

8. A heat exchanger in accordance with claim 1, wherein:

said expanded metal adjacent said edge zones is formed with a folded shape and is held by said fastening pins and washers.

9. A heat exchanger in accordance with claim 4, wherein:

said expanded metal adjacent said edge zones is formed with a folded shape and is held by said fastening pins and washers.

10. A heat exchanger in accordance with claim 1, wherein:

said expanded metal covers an entire surface of said ceramic mats and said expanded metal is held by said plurality of fastening pins and washers.

11. A heat exchanger in accordance with claim 4, wherein:

said expanded metal covers an entire surface of said ceramic mats and said expanded metal is held by said plurality of fastening pins and washers.

12. A heat exchanger in accordance with claim 10, wherein:

one of heat resistant material, bulk wool and additional said heat insulating material, is used for said ceramic moleskin mat segments;

one of said heat resistant material, said bulk wool and said additional heat insulating material, is arranged within said expanded metal.

* * * * *